US007246402B2

(12) United States Patent
Washburn

(10) Patent No.: US 7,246,402 B2
(45) Date of Patent: Jul. 24, 2007

(54) VARIABLE ANGLE CORNER TOOL

(75) Inventor: Fred Washburn, Naramata (CA)

(73) Assignee: Wal-Tech Industries Ltd., Penticton, B.C. (CA)

( * ) Notice: Subject to any disclaimer, the term of this patent is extended or adjusted under 35 U.S.C. 154(b) by 234 days.

(21) Appl. No.: 10/906,162

(22) Filed: Feb. 4, 2005

(65) Prior Publication Data

US 2006/0174437 A1 Aug. 10, 2006

(51) Int. Cl.
*B05C 17/10* (2006.01)

(52) U.S. Cl. ..... 15/235.7; 425/458

(58) Field of Classification Search ..... None
See application file for complete search history.

(56) References Cited

U.S. PATENT DOCUMENTS 4,767,297 A * 8/1988 Mower et al. ..... 425/87

6,155,809 A * 12/2000 Edwards et al. ..... 425/87

* cited by examiner

*Primary Examiner*—David Redding
(74) *Attorney, Agent, or Firm*—Sean W Goodwin; Jacquelyn VanLierop

(57) ABSTRACT

An adjustable corner tool is provided having outwardly biased blades. The back surfaces of the blades are connected to an angle control assembly that includes fixed-length arms pivotally connected between each of the blades and a central mounting block. Springs rotationally bias the arms away from each other such that the arms push against the back surfaces of the blades to urge the blades apart. In use, resistive force applied against the front surfaces of the blades moves the blades together. Thus, the adjustable corner tool dynamically adjusts to variations in wall corner angles. The adjustable corner tool can be used with corners in the range of about 160 degrees to 40 degrees and the angle of the tool can also optionally be fixed or maximally limited. In addition, the adjustable corner tool may be adapted to also function as an injection head for delivering spreadable material to a corner.

20 Claims, 9 Drawing Sheets

VARIABLE ANGLE CORNER TOOL

CROSS-REFERENCE TO RELATED APPLICATION

This application is related to U.S. provisional application Ser. No. 60/539,963 filed Jan. 30, 2004. The entire disclosure of the provisional application is considered to be part of the disclosure of this specification and is hereby incorporated by reference.

FIELD OF THE INVENTION

The invention relates to adjustable corner tools and in particular to variable angle corner tools for use in finishing corners with spreadable material such as drywall compound.

BACKGROUND OF THE INVENTION

Drywall corner tools are commonly used to finish wall corners provided by adjacent intersecting walls. Many conventional drywall corner finishing tools in the marketplace are limited to applications against typical 90 degree angular inside corner wall joints. In recent years, the use of other angular measurements have been incorporated in building construction, resulting in larger and smaller angles than 90 degrees, such as vaulted ceilings or corner bay window coves.

Angles other than 90 degrees can be finished by hand using a joint knife or variable angle hand trowel. This method is very time consuming since each side of the angle must be finished separately and allowed to dry. To assist in this finishing process, a product called "corner bead" was made available in a variety of popular angles, which is placed into the corner to fill the joint gap and provide a straight vertical corner line before drywall compound (mastic or mud) is applied and finished by hand. Such corner bead strips, however, increase the cost of drywalling.

To alleviate problems associated with variable wall corner angles, drywall corner tools have been developed having adjustable corner angles. For example, such tools have been disclosed in U.S. Pat. No. 5,442,832, issued on Aug. 22, 1995; U.S. Pat. No. 5,467,497, issued on Nov. 21, 1995; U.S. Pat. No. 5,544,384 issued on Aug. 13, 1996; and U.S. Pat. No. 5,774,924, issued on Jul. 7, 1998. Each of these patents disclose corner tools having hinged blades for pivotal movement of the blades about the hinge axis to form a variety of corner angles. Slideably or pivotally connected arms extend between the blades to support the blades and adjust the blades to a desired corner angle. Typically, the angle is fixed by a locking member that prevents sliding or rotation of the arms about the handle prior to use. Alternatively, the '497 patent discloses a locking pin bolt extending through the hinge for fixing the blades at a desired angle.

In some cases, a particular wall corner angle is variable, either by design or because the corner is not true, such that fixedly variable angle corner tools may not adequately finish such a corner. Although it is possible to not fix the angle of the prior art corner tools to allow the blades to move together for adjusting to decreasing wall corner angles during use, the blades will not automatically return to their original position or adjust to increasing wall angles.

There is, therefore, a need for an improved adjustable corner tool.

SUMMARY OF THE INVENTION

An improved adjustable corner tool for finishing wall corners with spreadable material is provided that allows the angle defined by the blades of the corner tool to dynamically adjust to variations in wall corner angles during use. The corner tool can be used for finishing wall corners in the range of about 160 degrees to 40 degrees and can also be fixed at a specific angle is so desired, therefore is useful for a wide variety of applications.

In one embodiment invention, the adjustable corner tool comprises a pair of hinged blades that are outwardly biased to urge the blades apart and whereby force applied against the blades moves the blades together. To outwardly bias the blades, an angle control assembly is connected between the back surfaces. Generally, the angle control assembly includes a central mounting block, fixed-length arms pivotally connected to each of the blades and the central mounting block, and springs that rotate the arms away from each other to thereby outwardly bias the blades. preferably, pairs of spaced upper and lower arms are used to optimize the transfer of force between the angle control assembly and the length of the blades. Furthermore, while only one spring is required to outwardly bias the blades, preferably at least two springs are used, with each spring acting on an arm connected to one or the other blades. The invention may also be adapted to suit a variety of purposes. For example, the arms can be clamped to resist or prevent rotation and thereby substantially fix the angle of the corner tool. Stops that prevent rotation of the arms can also be used to define a maximum angle of the corner tool.

In a broad aspect of the invention, there is provided an adjustable corner tool comprising: first and second blades, each blade having a mating edge, a front surface and a back surface, the blades hingedly connected at the mating edges, the back surfaces defining an angle; and an angle control assembly connected between the back surfaces, the angle control assembly outwardly biasing the blades to urge the blades apart to increase the angle and wherein pressure applied against the front surfaces moves the blades together to thereby decrease the angle.

In another broad aspect of the invention, there is provided an angle control assembly for a corner tool having first and second blades, each blade having a mating edge, a front surface and a back surface, the blades hingedly connected at the mating edges, the back surfaces defining an angle, the angle control assembly comprising: first and second mounting plates; and a mounting block pivotally connected between first and second mounting plates, the angle control assembly outwardly biasing the first and second mounting plates for moving the plates apart, wherein attachment of the first mounting plate to the first blade and attachment of the second mounting plate to the second blade outwardly biases the blades to urge the blades apart to increase the angle and wherein pressure applied against the front surfaces moves the blades together to thereby decrease the angle.

The adjustable corner tool may be used with any spreadable material, such as drywall compound, plaster, and grout. Although the adjustable corner tool is intended for use in finishing wall corners, it can be used in any application in which finishing of such spreadable material in a corner is required. The adjustable corner tool may also be modified to also function as an injection head for applying spreadable material to a corner.

BRIEF DESCRIPTION OF THE DRAWINGS

In drawings which are intended to illustrate embodiments of the invention and which are not intended to limit the scope of the invention.

DESCRIPTION OF THE PREFERRED EMBODIMENT

Figure 1A:
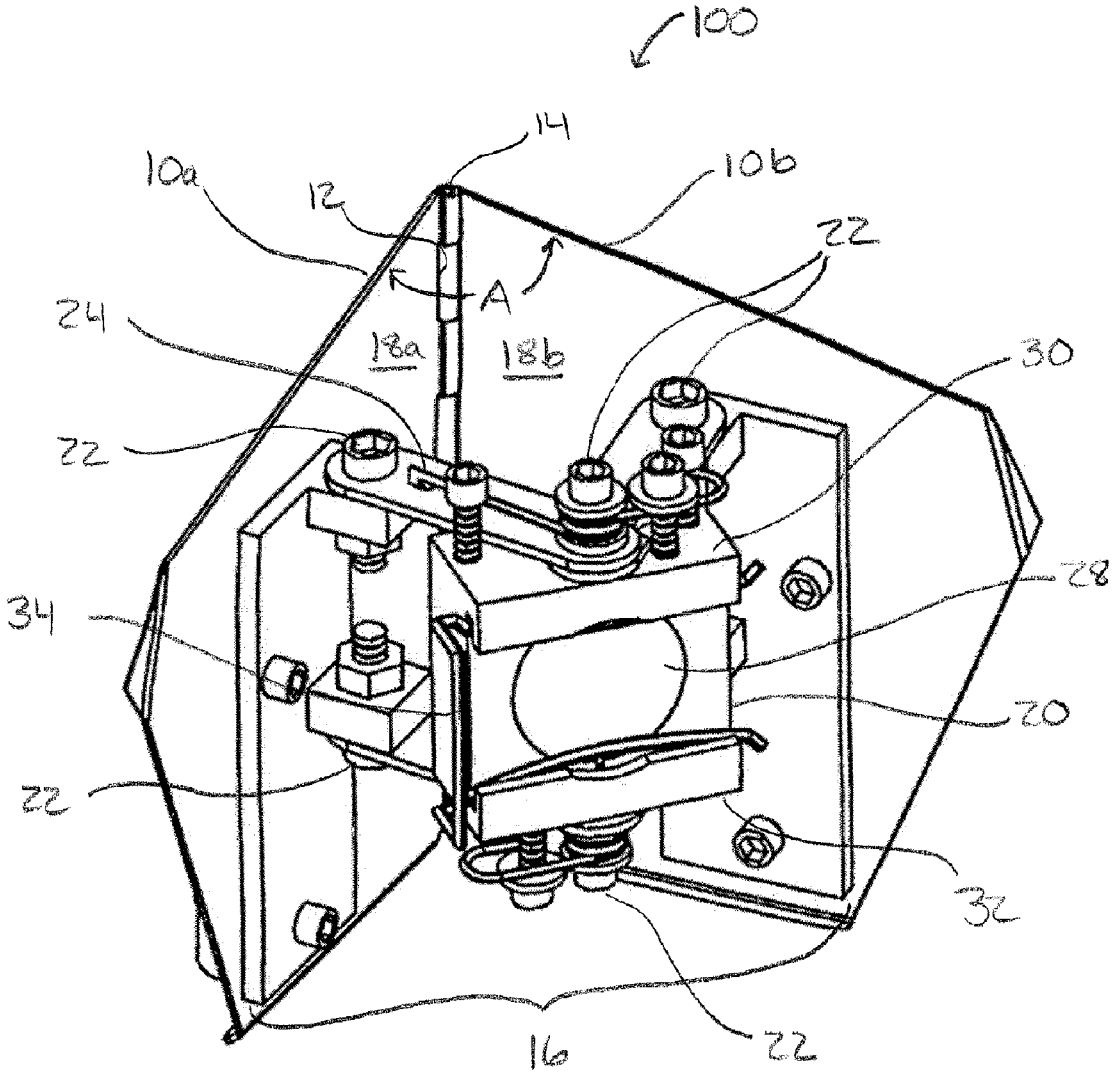
FIG. 1A is a back perspective view of one embodiment of an adjustable corner tool of the present invention.
Figure 1B:
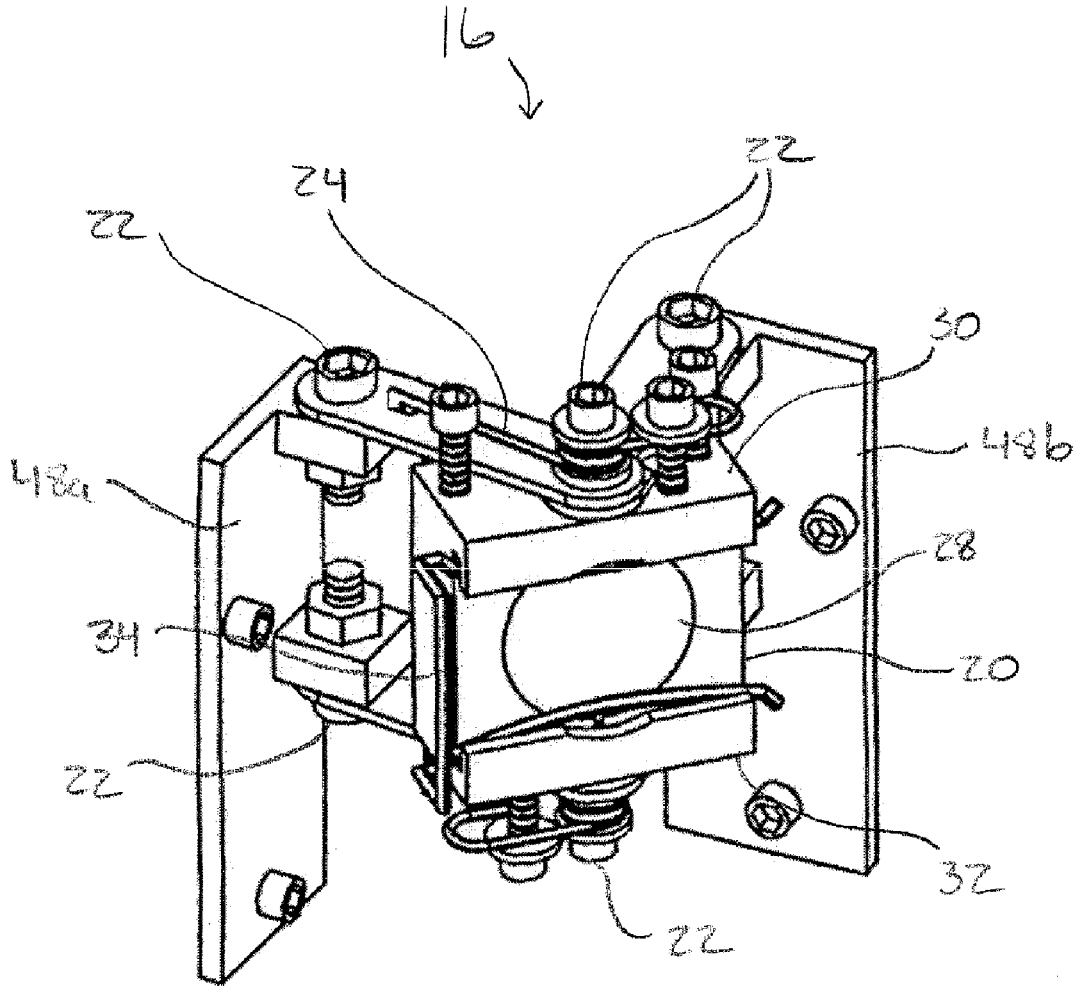
FIG. 1B is a back perspective view of the angle control assembly of FIG. 1A shown in isolation from the blades.
Figure 2:
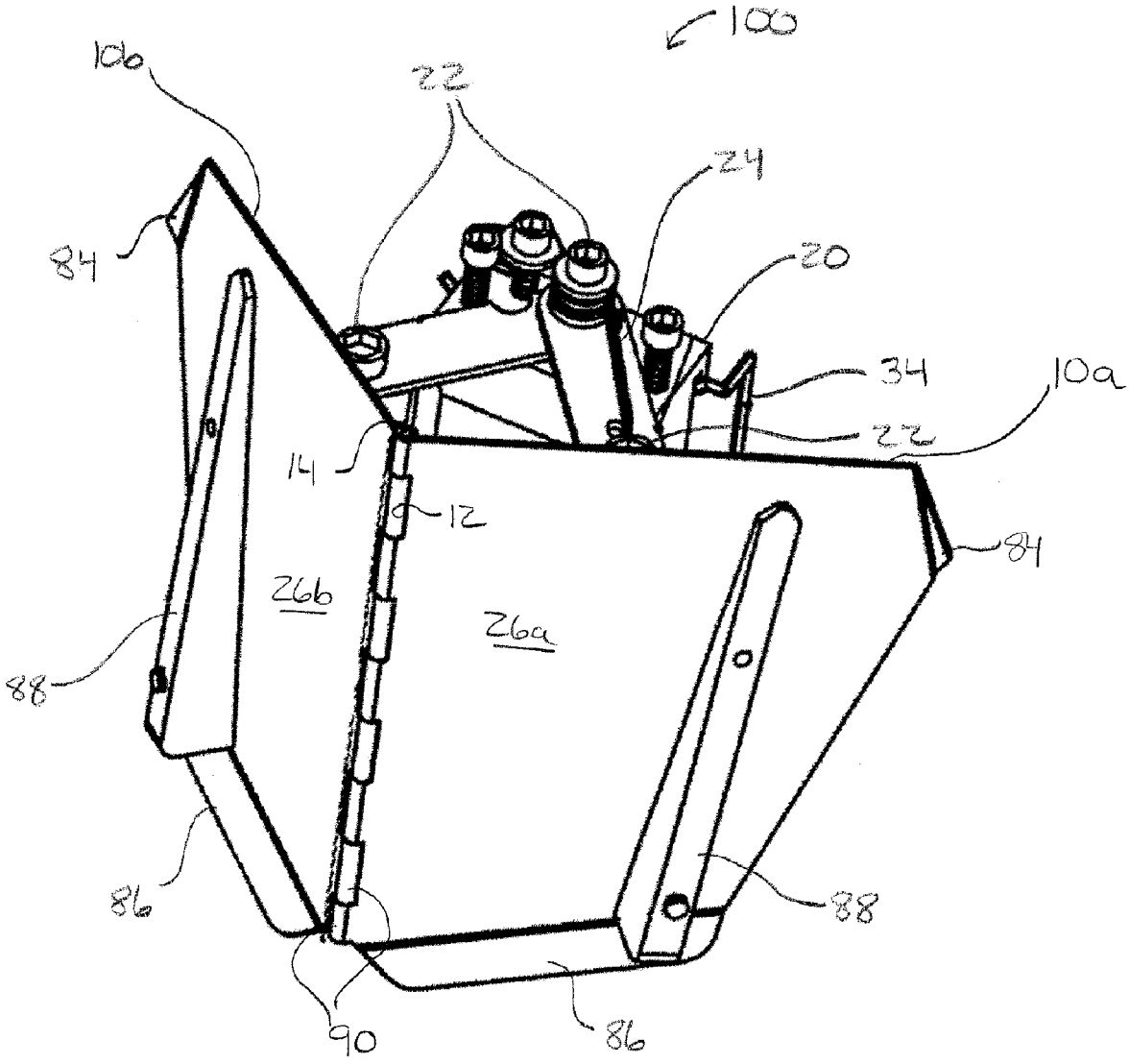
FIG. 2 is a front perspective view of the adjustable corner tool according to FIG. 1.

Referring to FIGS. 1A-3C, a variable angle corner tool 100 is shown having generally planar outwardly biased first and second blades 10*a*, 10*b* connected at mating edges 12 by a hinge 14 and an angle control assembly 16 positioned between the back surfaces 18*a*, 18*b* of the blades 10*a*, 10*b*. Herein, the surface of the blades 10*a*, 10*b* which engage the wall are deemed to be the front surface 26*a*, 26*b* and the opposing surface accessed by an operator is a back surface 18*a*, 18*b*. The angle control assembly 16 maintains a general V arrangement of the blades 10*a*, 10*b* and allows the angle A defined by the back surfaces 18*a*, 18*b* to be dynamically adjusted from about 160 degrees to 40 degrees, as particularly seen in FIGS. 3A-C. The angle control assembly 16 includes a mounting block 20 positioned between the back surfaces 18*a*, 18*b*, pivotal connections 22 between each of the mounting block 20 and the first and second blades 10*a*, 10*b*, and outwardly biasing means 24. The pivotal connections 22 allow the blades 10*a*, 10*b* to move apart or together upon application of appropriate force to the blades 10*a*, 10*b*, typically initiated through the mounting block 20. In particular, outwardly biasing force provided by the outwardly biasing means 24 urges the blades 10*a*, 10*b* apart to thereby increase the angle A, while reactive force applied against the front surfaces 26*a*, 26*b* acts against the outwardly biasing force to move the blades 10*a*, 10*b* together to thereby decrease the angle A.

The mounting block 20 also provides a point of attachment for a handle (not shown), such as a pole, to assist the user in the operation of the corner tool 100. As shown, the mounting block 20 provides a socket 28 between upper and lower ends 30, 32 for accommodating a pole with a conventional ball joint and as secured by a retaining spring clip 34.

Figure 4:
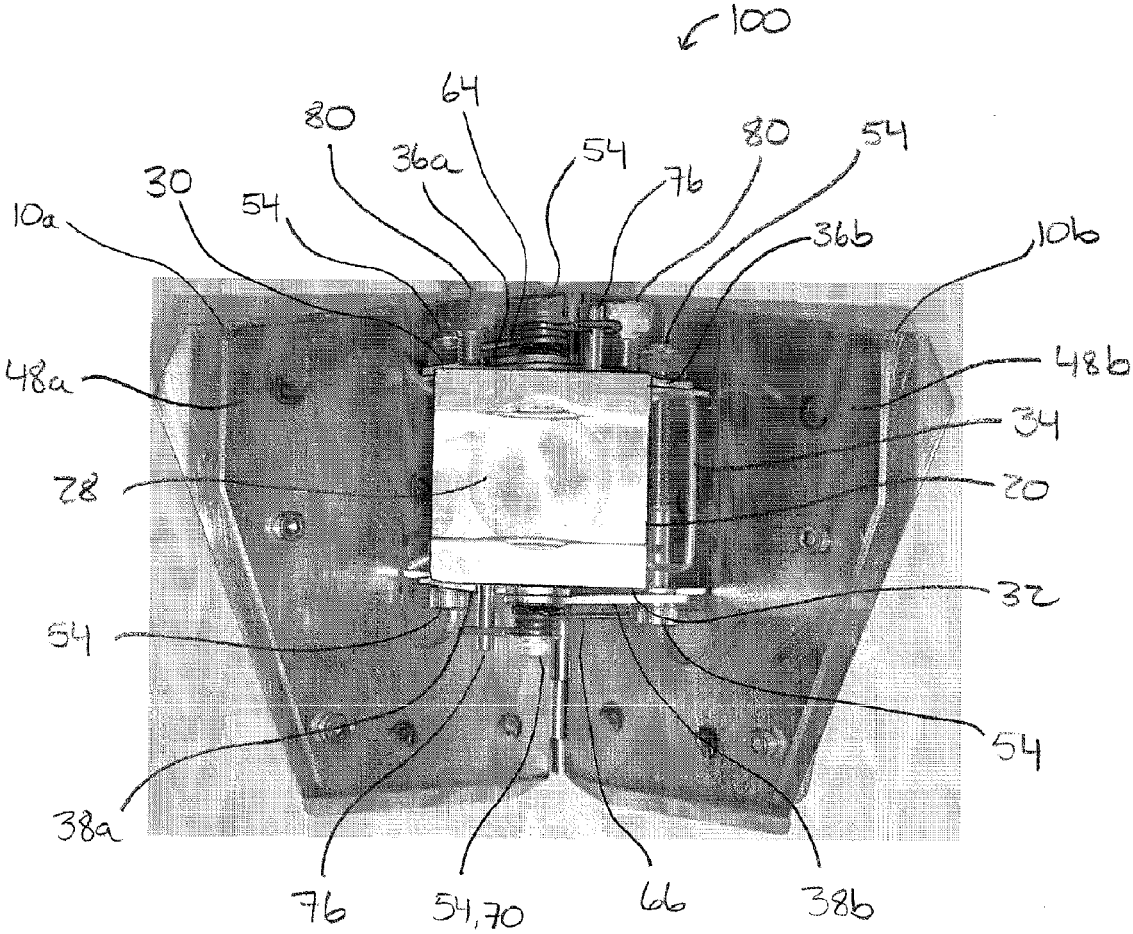
FIG. 4 is a back view of the adjustable corner tool of the present invention according to FIG. 3B FIGS. 5A and 5B are top plan and bottom plan views, respectively, of the adjustable corner tool according to FIG. 1.
Figure 5A:
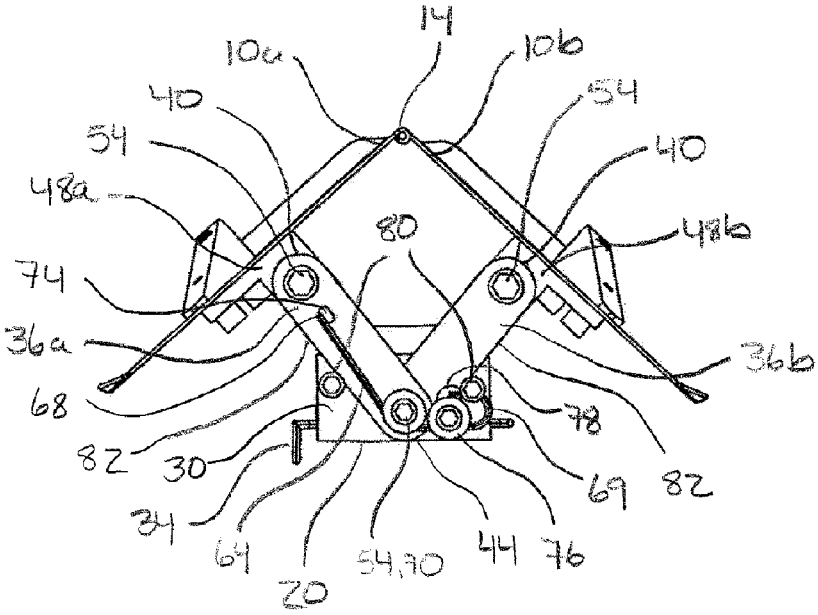
Figure 5B:
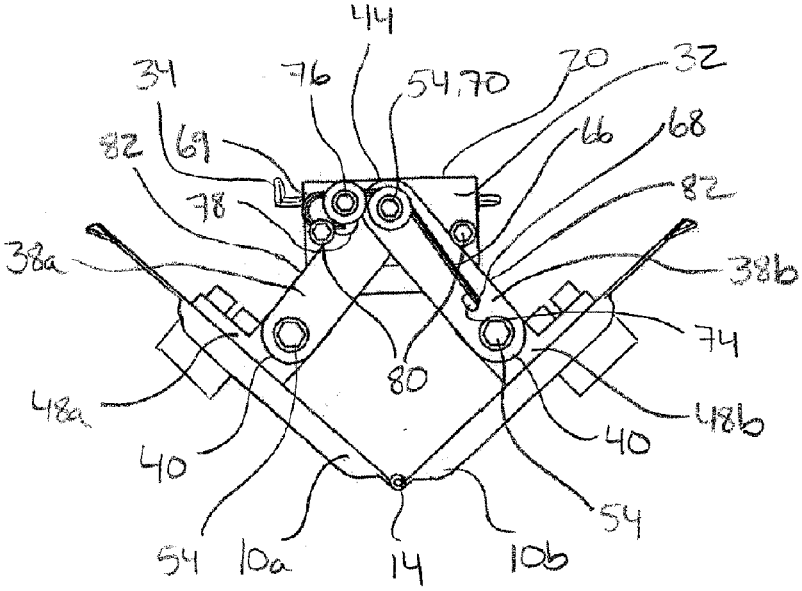
Figure 6:
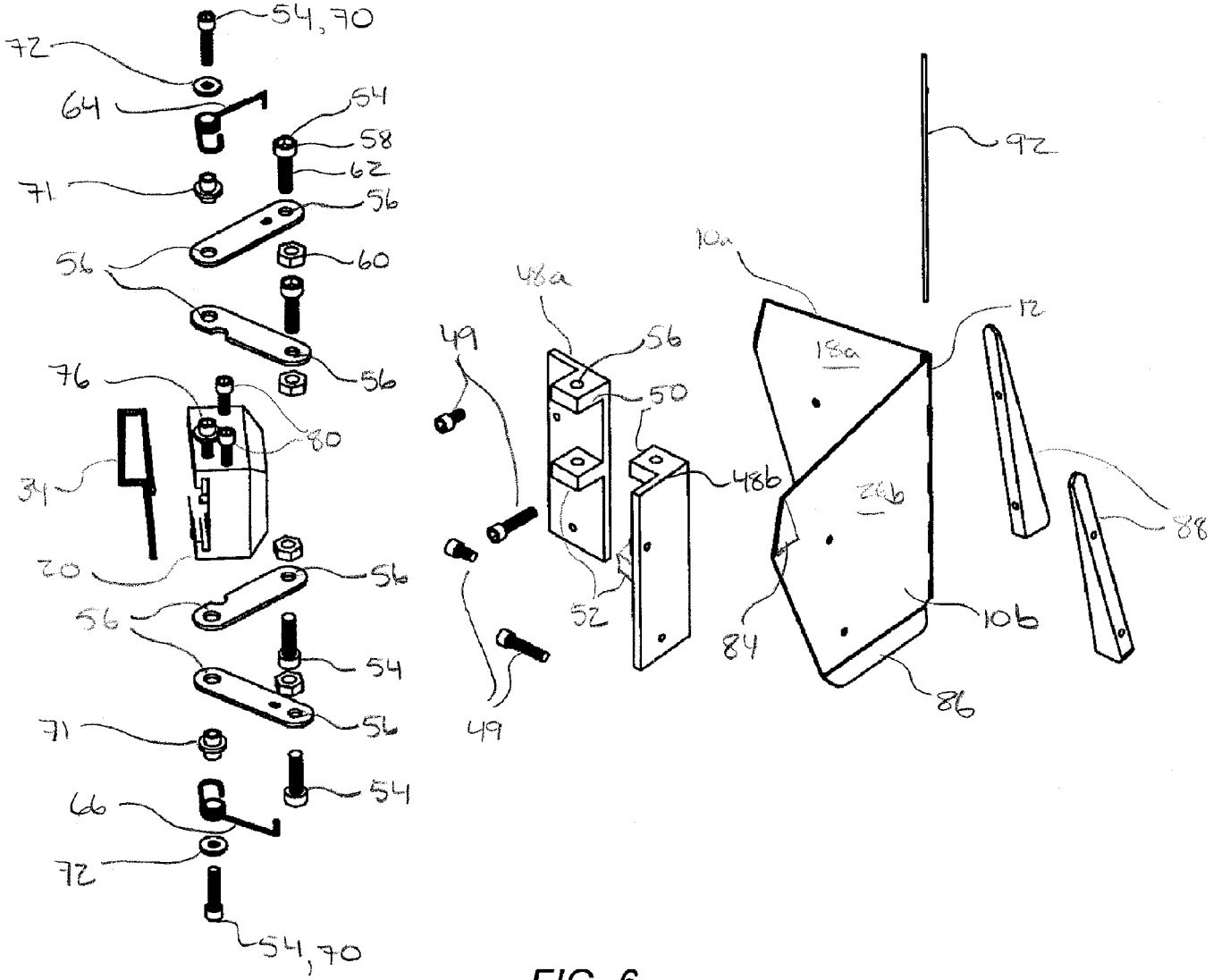
FIG. 6 is an exploded view of the adjustable corner tool according to FIG. 1.

With further reference to FIGS. 4-6 the pivotal connections 22 of the angle control assembly 16 are provided by pivotally connected arms 36*a*, 36*b*, 38*a*, 38*b* extending at a fixed length between the mounting block 20 and the blades 10*a*, 10*b*. More particularly, each of a spaced apart first upper arm 36*a* and first lower arm 38*a* is pivotally connected at a distal end 40 to the first blade 10*a*, while each of a spaced apart second upper arm 36*b* and second lower arm 38*b* is pivotally connected at a distal end 40 to the second blade 10*b*, with the upper arms 36*a*, 36*b* and lower arms 38*a*, 38*b* each pivotally connected at a proximal end 44 to upper and lower ends of the mounting block 30, 32. For connection of the arms 36*a*, 36*b*, 38*a*, 38*b* to the blades 10*a*, 10*b*, first and second mounting plates 48*a*, 48*b* are attached to the first and second blades 10*a*, 10*b*. A pair of upper and lower posts 50, 52 extend perpendicularly from each of the mounting plates 48*a*, 48*b* to which the upper arms 36*a*, 36*b* and lower arms 38*a*, 38*b* are respectively attached.

The mounting plates 48*a*, 48*b* are attached to the blades 10*a*, 10*b* by any suitable means, such as bolts 49 or welding. While the mounting plates 48*a*, 48*b* may be of any suitable shape (FIGS. 1A and 4), mounting plates 48*a*, 48*b* that substantially cover the back surfaces 18*a*, 18*b*, as particularly seen in FIG. 4, are preferred for providing structural support to the blades 10*a*, 10*b*.

pivotal connection of the arms 36*a*, 36*b*, 38*a*, 38*b* is achieved by passing a suitable pivot fastener 54, such as a rivet, pin or bolt, through aligned pivot holes 56 formed in the arms 36*a*, 36*b*, 38*a*, 38*b*, mounting plates 48*a*, 48*b*, and mounting block 20, as required. Preferably, each pair of upper arms 36*a*, 36*b* and lower arms 38*a*, 38*b* are pivotally connected to the mounting block 20 by a single pivot fastener 54, thereby providing a common pivot point for each pair of upper arms 36*a*, 36*b* and lower arms 38*a*, 38*b*. The pivot fasteners 54 can be adjustable to clamp the arms 36*a*, 36*b*, 38*a*, 38*b* to provide variable resistance to pivotal movement of the arms 36*a*, 36*b*, 38*a*, 38*b* or to lock the arms 36*a*, 36*b*, 38*a*, 38*b* in place at a specific angle, as desired. For example, as shown, the pivot fastener 54 is a threaded bolt whereby the fastened arm is retained between the head of the bolt 58 and a nut 60 threaded onto the shaft 62. To clamp the arms 36*a*, 36*b*, 38*a*, 38*b*, the nut 60 is simply threaded further onto the shaft 62, while loosening of the nut 60 will unclamp the arm 36*a*, 36*b*, 38*a*, 38*b*. Alternatively, upper and lower fasteners may interconnect to form such a nut-and-bolt arrangement, as seen in FIG. 4.

In general, the outwardly biasing means 24 acts between any of the arms 36*a*, 36*b*, 38*a*, 38*b* and the mounting block 20 to rotate the respective arm 36*a*, 36*b*, 38*a*, 38*b* about the pivot fastener 54, while the arms 36*a*, 36*b*, 38*a*, 38*b* act between the mounting block 20 and the blades 10*a*, 10*b* to move the blades 10*a*, 10*b* outwardly and away from each other. In particular, the outwardly biasing means 24 includes upper and lower springs 64, 66 attached to the first upper arm 36*a* and the second lower arm 38*b*, respectively. To pre-load the springs 64, 66, a distal end of each spring 66 is secured to its respective arm 36*a*, 38*b*, a proximal end of each spring 69 is secured to the mounting block 20, and the coils of the springs 64, 66 are positioned about a biasing post 70. Conveniently, the biasing posts 70 correspond to the pivot fasteners 54 positioned on the mounting block 20, with a bushing 71 and washer 72 also positioned around the fastener 54. The springs rotationally bias the arms 36*a*, 38*b* to rotate the arms 36*a*, 38*b* away from each other so that the mounting block 20 moves toward the back surfaces 18*a*, 18*b* (see FIGS. 3A-3C) causing the arms 36*a*, 38*b* to push against the blades 10*a*, 10*b* and urge the blades 10*a*, 10*b* apart. In other words, the upper spring 64 acts on the first upper arm 36*a* to outwardly bias the first blade 10*a*, while the lower spring 66 acts on the second lower arm 38*b* to outwardly bias the second blade 10*b*. Alternatively, the upper and lower springs 64, 66 may be inversely attached to the upper second arm 36*b* and lower first arm 38*a* without affecting the overall operation of the corner tool 100.

Any suitable means for securing the distal and proximal ends of the springs 68, 69 may be used. As shown, the distal end of the springs 68 are hooks that are inserted into spring holes 74 formed in the arms 36*a*, 38*b*, while U-shaped proximal ends 68, 69 are positioned about spring retainer pins 76 attached to the upper and lower ends of the mounting blocks 30, 32 and adjacent to the respective biasing posts 70. To prevent the spring retainer pins 76 from interfering with the pivotal movement of the arms 36*a*, 36*b*, 38*a*, 38*b*, cut-outs 78 are provided in the arms 36*a*, 36*b*, 38*a*, 38*b*, as required.

Figure 3A:
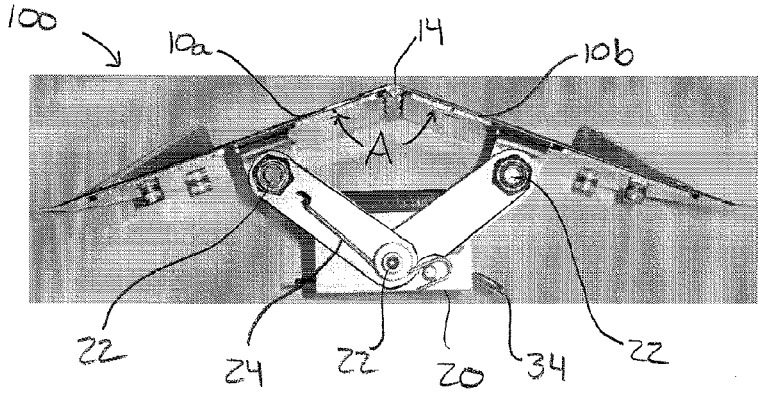
FIGS. 3A-C are top plan views of another embodiment of a corner tool of the present invention, with the blades actuated to 160 degrees (with the stops removed in FIG. 3A), 95 degrees and 40 degrees, respectively.
Figure 3B:
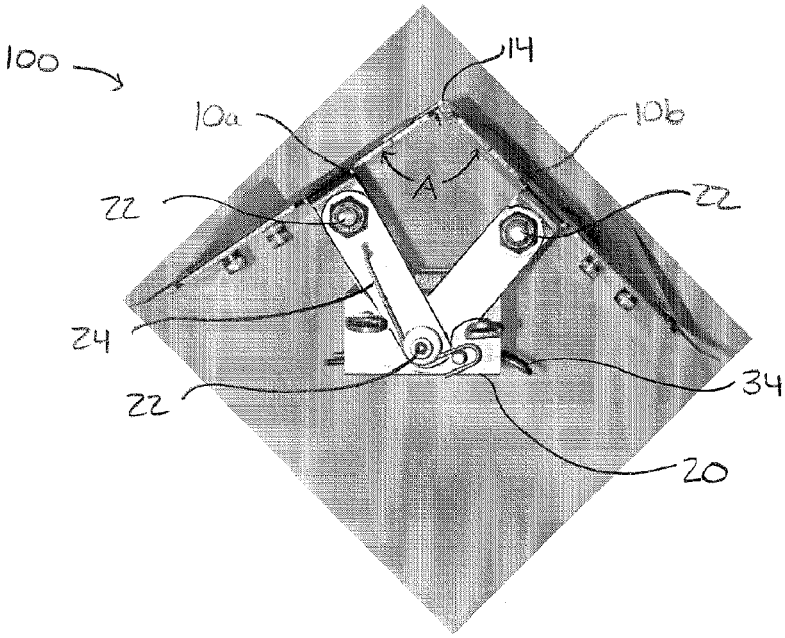
Figure 3C:
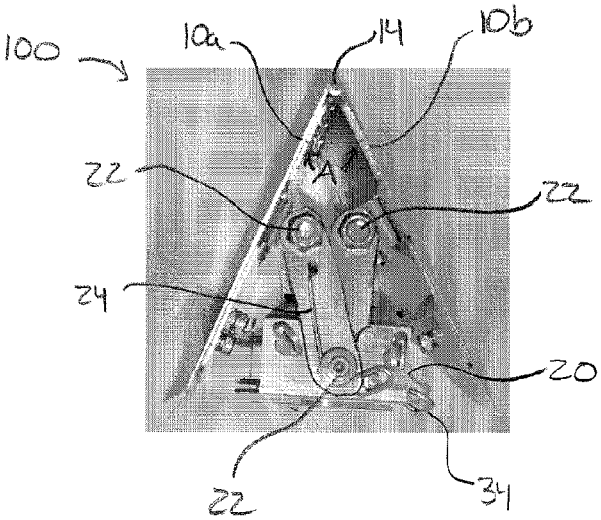

In use for finishing a wall corner, the outwardly biased blades 10*a*, 10*b* of the corner tool 100 form a first angle that is larger than the maximum angle of the wall corner. The corner tool 100 is then placed in the wall corner, generally having drywall compound or other spreadable material applied thereto, with the front surfaces 26*a*, 26*b* engaging the walls. Moderate pressure is applied upon the mounting block 20 towards the blades 10*a*, 10*b* to push the corner tool 100 into the wall corner and, consequently, resistive forces applied to the blades 10*a*, 10*b* compress the springs 64, 66 and cause the blades 10*a*, 10*b* to move together to form a second angle corresponding to the angle of the wall corner. As the corner tool 100 is stroked along the length of the wall corner with continual application of pressure to spread the compound, the angle A of the blades 10*a*, 10*b* will adjust to substantially always match the angle of the wall corner. In particular, the combination of the outward biasing and the pivotal connection of the blades 10*a*, 10*b* allow the angle A to dynamically increase or decrease according to variations in the wall corner angle, such as if the corner is not true.

preferably, the first angle of the blades 10*a*, 10*b* is slightly larger than the maximum angle of the wall corner. For example, for a right angle wall corner, the first angle may be 95 degrees. To restrain the blades 10*a*, 10*b* to a maximum angle, stops 80, such as bolts, are positioned on the mounting block 20 adjacent to an outer edge 82 of each of the arms 36*a*, 36*b*, 38*a*, 38*b* to restrict rotational biasing of the arms 36*a*, 38*b*, 38*a*, 38*b*. If the desired first angle is larger that maximally permitted by the stops 80, the stops 80 may be removed as necessary, as seen in FIG. 3A. In addition, the placement of stops 80 beside pairs of first and second arms 36*a*, 36*b*, 38*a*, 38*b* also act to help keep the mounting block 20 centered to the blades 10*a*, 10*b*, particularly if the user is standing off-center of the corner tool 100 when pressure is being applied.

While the invention has thus far been described with respect to the preferred embodiment, other embodiments are also contemplated. For example, outwardly biasing means 24 may be attached to all of the arms or to only one arm 36*a*, 36*b*, 38*a*, 38*b*. Alternatively, only one pair of first and second arms 36*a*, 36*b* or 38*a*, 38*b* can be used with outwardly biasing means 24 attached to one or both arms 36*a*, 36*b*, 38*a*, 38*b*. Notably, the use of outwardly biasing means 24 for biasing both the first and second blades 10*a*, 10*b* allows force to be applied equally through to both blades 10*a*, 10*b* if uneven force is applied, such as if the user is standing off-centre of the corner tool 100. In addition, the arrangement of the spaced apart upper and lower arms 36*a*, 36*b* and 38*a*, 38*b* provides structural support along the length of the corner tool 100 as force is being applied.

Figure 7:
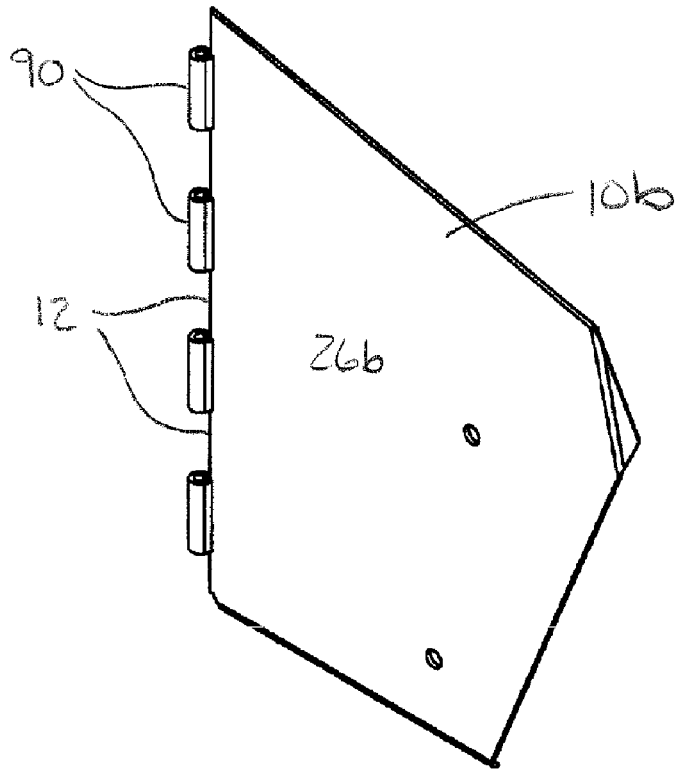
FIG. 7 is a perspective view of a blade of the adjustable corner tool of the present invention.

With reference to FIGS. 6 and 7, the blades 10*a*, 10*b* may be of any shape suitable for the construction and purpose of the corner tool 100. As shown, the blades 10*a*, 10*b* are as found in a typical drywall flusher head, with each blade having a general wing shape with angled tips 84 and lower edges 86 and downwardly projecting sliders 88 extending from each of the front surfaces 26*a*, 26*b*.

Figure 8:
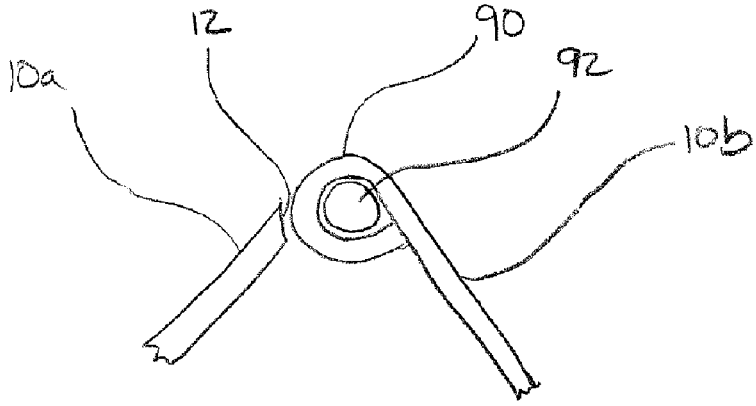
FIG. 8 is a top plan view of an embodiment of a portion of the hinge connection of an adjustable corner tool of the present invention having a beveled mating edge.

Any hinge connection that permits pivotal movement of the blades can be used. For example, with reference to FIGS. 7 and 8, the hinge 14 is a piano hinge formed from spaced apart hinge cylinders 90 projecting from and extending along the mating edge 12 of each of the blades 10*a*, 10*b*. The hinge cylinders 90 are aligned for receiving a rod 92 therethrough, such that the mating edge 12 of each blade 10*a*, 10*b* is adjacent to the hinge cylinders 90 of the other blade 10*a*, 10*b*. In general, the hinge connection should be substantially flush with the front surfaces 26*a*, 26*b* to minimize impact on the surface of the finished corner. Furthermore, with particular reference to FIG. 8, the mating edge 12 may be chamfered or beveled inwardly to allow for a substantially tight fitting of the mating edge 12 with the hinge member 90 and therefore allow for a smoother finish. For example, for a hinge having an outer diameter of about ⅛", the mating edge is beveled at about 60 degrees.

The corner tool 100 may be made of any material suitable for the purpose for which it is intended, including metal, plastic, or a combination thereof. In addition, the corner tool 100 may be constructed in any manner which achieves the ultimate function. For example, the posts 50, 52 may be integrally formed with the blades 10*a*, 10*b* such that mounting plates 48*a*, 48*b* perse are not required.

Figure 9A:
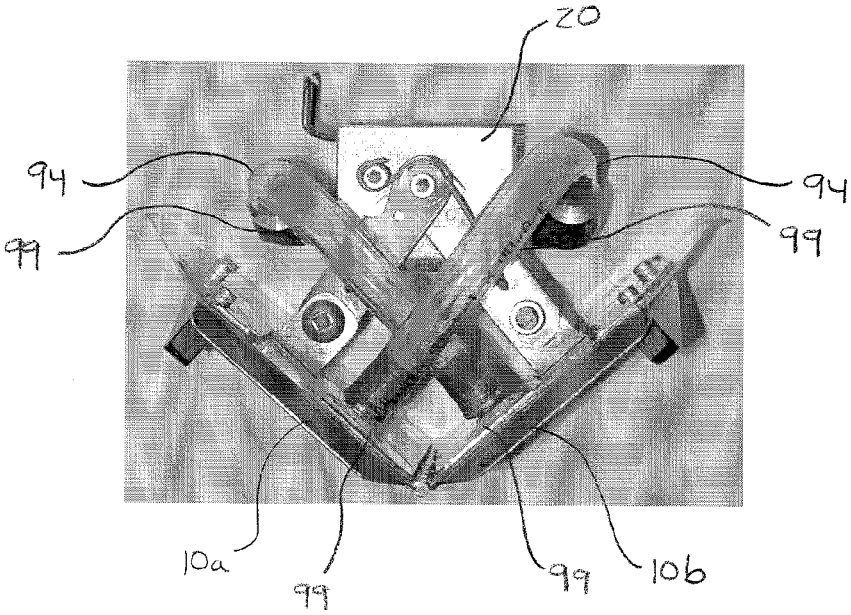
FIG. 9A is a bottom plan view and FIG. 9B is a back view of another embodiment of an adjustable corner tool of the present invention having an injection head modification.
Figure 9B:
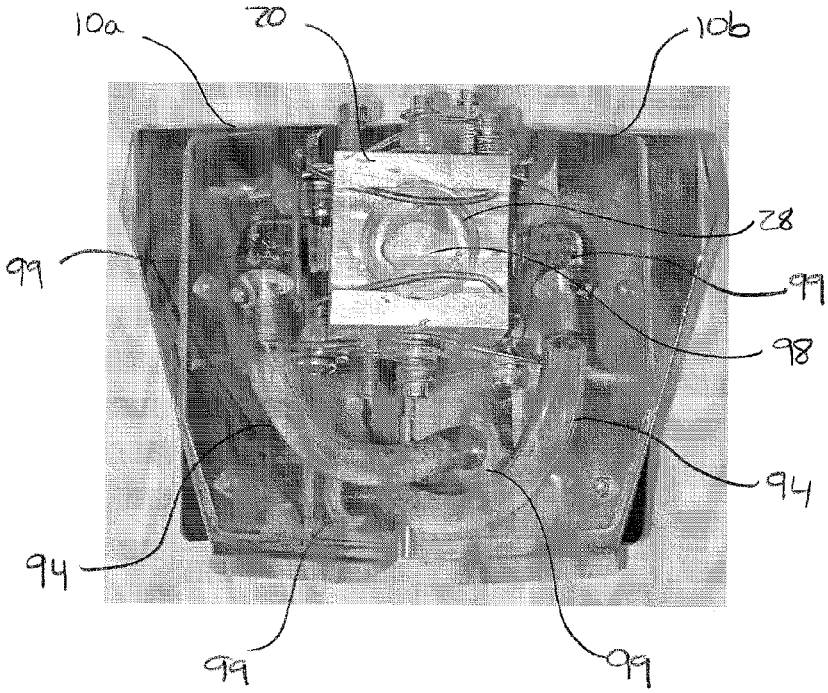

Referring to FIGS. 9A and 9B, the corner tool 100 can be modified to also function as an injection head for applying spreadable material, such as drywall compound, to a wall corner. In this case, the socket 28 in the mounting block 20 accommodates a compound conduit having a ball member (not shown) and the socket 28 is adapted to include a cavity 98. Tubing 94 is connected between openings (not visible) in the mounting block 20 and the blades 10*a*, 10*b*, where the openings in the mounting block 20 are in communication with the cavity 98. Preferably the mounting block 20 would have increased depth to accommodate the cavity 98 and the openings therein.

In use, a pump delivers drywall compound through the compound conduit to the socket 28 and the compound is injected into the cavity 98. The compound then flows through the tubing 94 to the front surfaces 26*a*, 26*b* of the blades 10*a*, 10*b*, where the compound can be spread along a wall corner with the corner tool 100, as described previously. If necessary, seals (not shown) are used to prevent leakage of compound from the socket 28.

One or more tubing 94 can be used, as desired, and the tubing 94 can be made of any flexible material that permits movement of the blades 10*a*, 10*b*. For example, as shown, the tubing 94 is plastic and fittings 99, such as brass fittings, are used to connect the tubing 94 to the mounting block 20 and the blades 10*a*, 10*b*. The tubing 94 can also be made of metal having hinged joints.

Although preferred embodiments of the invention have been described in some detail herein above, those skilled in the art will recognize that various substitutions and modifications of the invention may be made without departing from the scope of the invention as defined by the claims as defined herein.

What is claimed is:

1. An adjustable corner tool comprising:

first and second blades, each blade having a mating edge, a front surface and a back surface, the blades hingedly connected at the mating edges, the back surfaces being adjustable defining an adjustable angle within the range of about 40 degrees to about 160 degrees; and an angle control assembly connected between the back surfaces, the angle control assembly outwardly biasing the blades to urge the blades apart to increase the angle and wherein pressure applied against the front surfaces moves the blades together to thereby decrease the angle.

2. The adjustable corner tool of claim 1 wherein the angle control assembly further comprises a mounting block pivotally connected between the first and second blades.

3. The adjustable corner tool of claim 2 wherein the angle control assembly further comprises at least one pair of first and second arms, the first arm pivotally connected at a distal end to the first blade and pivotally connected at a proximal end to the mounting block, the second arm pivotally connected at a distal end to the second blade and pivotally connected at a proximal end to the mounting block, at least one of the arms rotationally biased to outwardly bias the blade attached thereto, thereby urging the blades apart.

4. The adjustable corner tool of claim 3 wherein both arms are outwardly biased.

5. The adjustable corner tool of claim 3 having a pair of first and second upper arms and a pair of first and second lower arms, the upper and lower pairs of arms spaced apart to sandwich the mounting block therebetween, the first upper arm being rotationally biased and the second lower arm being rotationally biased.

6. The adjustable corner tool of claim 3 wherein the angle control assembly further comprises releasable clamping means for providing resistance to the rotational movement of the arms.

7. The adjustable corner tool of claim 3 wherein the angle control assembly further comprises at least one stop member for limiting the outward rotation of one of the arms.

8. The adjustable corner tool of claim 7 having first and second stop members, the first stop positioned on the mounting block adjacent to an outer edge of the first arm, the second stop positioned on the mounting block adjacent to an outer edge of the second arm.

9. The adjustable corner tool of claim 3 wherein the angle control assembly further comprises first and second mounting plates, the first mounting plate attached to the back surface of first blade and the second mounting plate attached to the back surface of second blade, the first arm pivotally attached to the first mounting plate and the second arm pivotally attached to the second mounting plate.

10. The adjustable corner tool of claim 1 wherein the angle control assembly outwardly biases the blades by a spring.

11. The adjustable corner tool of claim 1 wherein the mating edges are beveled inwardly, the beveled edge of each blade adjacent to a hinge cylinder projecting from the mating edge of the other blade, wherein the beveled edge and the hinge cylinder form a substantially tight fit sufficient to produce a smooth finish.

12. The adjustable corner tool of claim 2, the mounting block adapted to receive a conduit for spreadable material, the adjustable corner tool further comprising:

tubing connected between the mounting block and the back surface of at least one of the blades, the tubing in communication with an opening in the mounting block and an opening end in at the at least one of the blades, wherein the tubing directs spreadable material delivered from the conduit into the mounting block to the front surface of the at least one blade.

13. An angle control assembly for a corner tool having first and first and second blades, each blade having a mating edge, a front surface and a back surface, the blades hingedly connected at the mating edges, the back surfaces being adjustable defining an adjustable angle within the range of about 40 degrees to 160 degrees, the angle control assembly comprising:

first and second mounting plates; and a mounting block pivotally connected between first and second mounting plates, the angle control assembly outwardly biasing the first and second mounting plates for moving the plates apart, wherein attachment of the first mounting plate to the first blade and attachment of the second mounting plate to the second blade outwardly biases the blades to urge the blades apart to increase the angle and wherein pressure applied against the front surfaces of the moves the blades together to thereby decrease the angle.

14. The angle control assembly of claim 13 further comprising at least one pair of first and second arms, the first arm pivotally connected at a distal end to the first mounting plate and pivotally connected at a proximal end to the mounting block, the second arm pivotally connected at a distal end to the second mounting plate and pivotally connected at a proximal end to the mounting block, at least one of the arms rotationally biased to outwardly bias the mounting plate attached thereto, thereby moving the mounting plates apart.

15. The angle control assembly of claim 14 wherein both arms are outwardly biased.

16. The angle control assembly of claim 14 having a pair of first and second upper arms and a pair of first and second lower arms, the upper and lower pairs of arms spaced apart to sandwich the mounting block therebetween, the first upper arm being otationally biased and the second lower arm being rotationally biased.

17. The angle control assembly of claim 14 further comprising releasable clamping means for providing resistance to the rotational movement of the arms.

18. The angle control assembly of claim 14 further comprising at least one stop member for limiting the outward rotation of one of the arms.

19. The adjustable corner tool of claim 18 having first and second stop members, the first stop positioned on the mounting block adjacent to an outer edge of the first arm, the second stop positioned on the mounting block adjacent to an outer edge of the second arm.

20. The angle control assembly of claim 14 wherein the angle control assembly outwardly biases the mounting plates by a spring.

* * * * *